United States Patent [19]

Mottershead

[11] Patent Number: 4,777,347

[45] Date of Patent: Oct. 11, 1988

[54] ELECTRIC WATER HEATING TANK WITH THERMOSIPHONIC CIRCULATION FOR IMPROVED HEAT RECOVERY RATE

[76] Inventor: Bernard J. Mottershead, 708 SW. 357th St., Federal Way, Wash. 98023

[21] Appl. No.: 92,082

[22] Filed: Sep. 2, 1987

[51] Int. Cl.[4] ..... H05B 3/82; F24H 1/20

[52] U.S. Cl. ..... 219/314; 126/362; 219/306; 219/312; 219/316

[58] Field of Search ..... 219/310, 312, 314–316, 219/318, 335, 336, 523; 126/361, 362; 122/13 A

[56] References Cited

U.S. PATENT DOCUMENTS

| | | | |
|---|---|---|---|
| 820,282 | 5/1906 | Brown . | |
| 985,344 | 2/1911 | Harvie . | |
| 1,451,863 | 4/1923 | Clark . | |
| 1,519,594 | 12/1924 | Shoemaker . | |
| 1,583,342 | 5/1926 | Dlugosch . | |
| 1,643,673 | 9/1927 | Merrill . | |
| 1,779,667 | 10/1930 | Fazekas . | |
| 1,863,273 | 6/1932 | Hofferbert | 219/312 |
| 2,066,190 | 12/1936 | Swars | 219/316 |
| 2,308,765 | 1/1943 | Mango | 219/316 |
| 2,375,871 | 5/1945 | Reifenberg | 219/316 |
| 2,376,537 | 5/1945 | Hall | 219/314 |
| 2,784,291 | 3/1957 | Harney | 219/314 |
| 2,804,534 | 8/1957 | Coates | 219/316 X |
| 3,546,429 | 12/1970 | Fleet | 219/312 |
| 4,103,319 | 7/1978 | Crain et al. | 361/106 |
| 4,403,137 | 9/1983 | Glazer | 219/306 |
| 4,587,401 | 5/1986 | Ekman | 219/314 |

FOREIGN PATENT DOCUMENTS

| | | | |
|---|---|---|---|
| 372497 | 5/1932 | United Kingdom | 219/314 |
| 487876 | 6/1938 | United Kingdom | 219/314 |

*Primary Examiner*—Anthony Bartis

*Attorney, Agent, or Firm*—Bruce A. Kaser

[57] ABSTRACT

An electric water heater has a vertically disposed tank with a lower cold water inlet, an upper hot water outlet and at least one horizontally disposed elongated immersion heating element extending into the region of the tank between the inlet and the outlet. Each heating element is surrounded by an elongated closed end tubular sleeve having a plurality of lower openings distributed along the length of the sleeve below the heating element therein and a plurality of upper opening distributed along the length of the sleeve above the heating element. The total area of the upper openings is greater than the area of the lower openings to generate upon operation of the heating element an upwardly directed transverse flow of water in a direction from the lower openings to the upper openings along the entire length of the sleeve. An unrestricted external bypass conduit interconnects the upper and lower portions of the tank and together with the sleeve surrounding each heating element generating a thermosiphon effect which improves heat transfer to the water in the tank and thus the heat recovery rate.

2 Claims, 2 Drawing Sheets

16
20
12
24
22
10
24
12
18
14

12
32
30A
30B
30
33

36
30
40
30B
30A
24
12
33
38

26
24
6
26
5
24
6
36
5
34
4
12
4
32
36
30A
30B
28

36
36
30A
30B
24
30
12
34

40
12
30

ELECTRIC WATER HEATING TANK WITH THERMOSIPHONIC CIRCULATION FOR IMPROVED HEAT RECOVERY RATE

DESCRIPTION

1. Technical Field

This application relates to water heaters, and particularly, to devices that improve the heating efficiency of water heaters.

2. Background Art

Water heaters having internal electric resistance heating elements are well-known and in common use both domestically and commercially. Conventional designs of this type typically consist of a water tank into which cold water is introduced near its bottom, and water heated by the elements is removed from its top. The heating elements are usually in the form of two metallic sheathed electric resistance heating elements of the Calrod ® type which extend into the tank from its inner sidewall and are fully exposed to the water in the tank.

Circulation of water inside the tank is normally very poor. This causes layers ("layering") of significantly cooler water to develop immediately below each element. The effect of layering on overall heating efficiency is two-fold: First, it impedes heat transfer from the elements to the water in the tank, which affects the heater's recovery rate in an undesirable manner. Second, to a certain extent layering reduces the effective hot water holding capacity of the heater.

As a person skilled in the art would know, water heater recovery rate is directly related to a water heater's capacity to heat an amount of cold water introduced into the tank in response to removal of heated water. Over the years, various improvements upon water heater designs have been developed, some for the specific purpose of improving recovery rate. Some of these improvements have related to ways of improving direct heat transfer from heating elements to water, such as U.S. Pat. Nos. 1,643,673 and 4,403,137. Others use conduits or tubes to transfer heated water from one tank region to another. This is shown, for example, in U.S. Pat. Nos. 3,546,429 and 4,587,401.

At least one significant difference between the invention disclosed herein and the prior art is that the present invention provides an apparatus for improving recovery rate by uniquely modifying the heating elements, and by providing a bypass conduit that acts in combination with the modified elements to improve overall heat transfer. This difference, and others, will become apparent upon review of the disclosure set forth hereinafter.

DISCLOSURE OF THE INVENTION

In accordance with the present invention, a thermosiphon apparatus is provided for improving a water heater's efficiency. The apparatus is readily adaptable to conventional water heater designs which typically include a water tank, a means for delivering water through an inlet into a lower region of the tank, and a means for removing water through an outlet from an upper region of the tank. Two electric heating elements, each immersed in water held in the tank, are positioned between the tank's upper and lower regions and extend generally horizontally inwardly into the tank from the tank's inner sidewall.

A tubular sleeve surrounds each heating element. The sleeve includes a first plurality of openings formed along the length of the sleeve above the heating element, and a second plurality of openings formed also along the length of the sleeve, but below the element. The total area of the upper openings exceeds the total area of the lower openings. Water trapped or held inside the sleeve and surrounding the element is quickly heated and the previously described arrangement of sleeve openings generates an upwardly directed flow of heated water.

An external bypass conduit is provided which connects the tank's upper and lower regions. The conduit permits unrestricted flow communication of water between the two regions. In other words, there is no valve or other orifice in the conduit that restricts flow.

The holes or openings in each sleeve, in combination with the bypass conduit, generate a thermosiphon effect. Normally, and as a person skilled in the art would know, heat tends to rise upwardly. This means the upper region of the tank would naturally tend to be warmer than the lower region. However, the thermosiphon effect generated by the apparatus causes a "rollover" of heated water from the upper to lower regions. This both eliminates layering in the tank and substantially improves the tank's recovery rate.

Operation of the apparatus will be more fully explained in the following description of the best mode for carrying out the invention, when read in conjunction with the accompanying drawings.

BRIEF DESCRIPTION OF THE DRAWINGS

In the drawings, like reference numerals are used to designate like parts throughout the several views, and.

BEST MODE FOR CARRYING OUT THE INVENTION

Figures 1, 2, 3, 4, 5, 6:
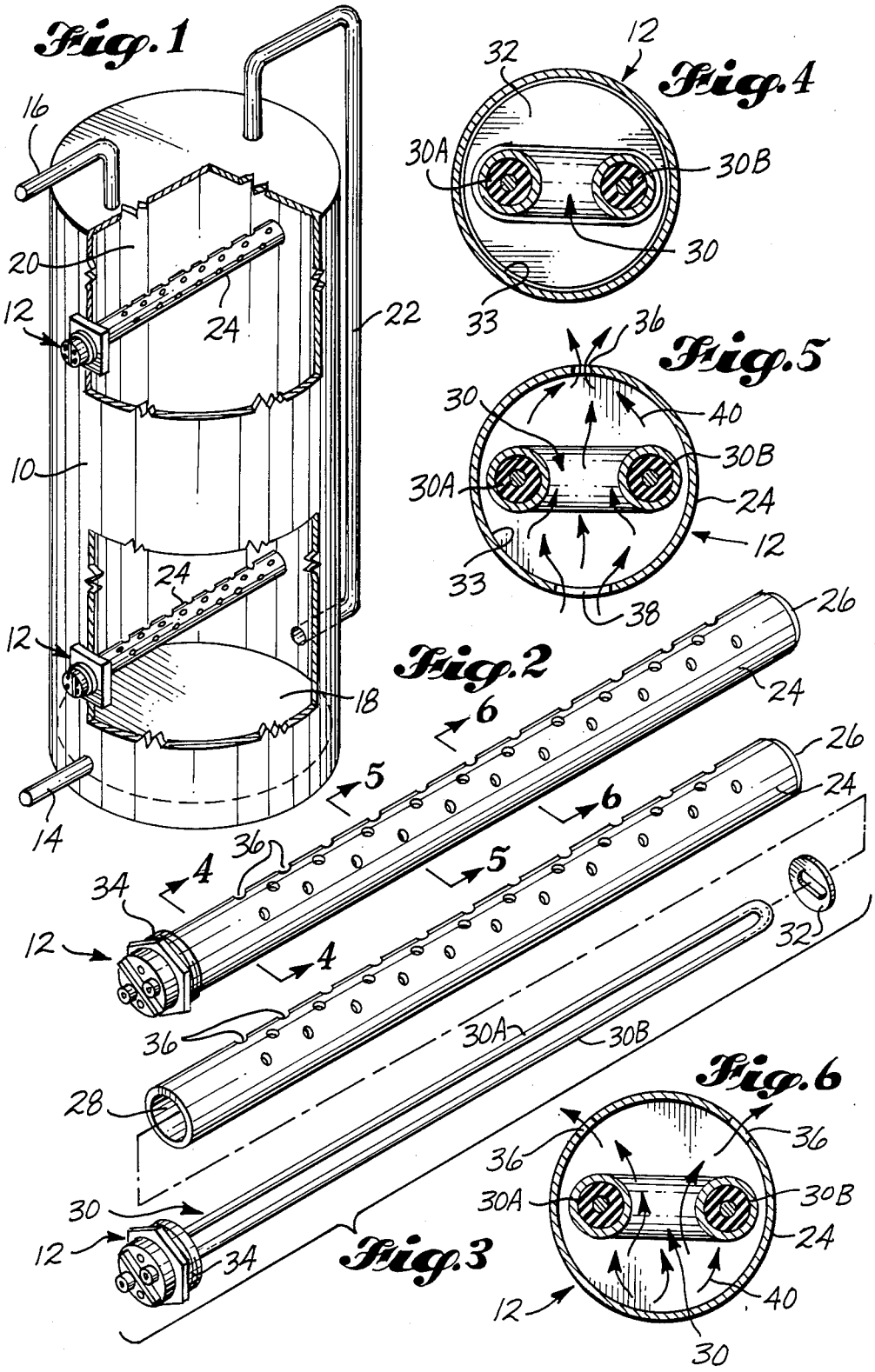
FIG. 1 is a pictorial view of a water heater modified by a thermosiphon apparatus that is constructed in accordance with a preferred embodiment of the invention, and has cut-away portions that show the placement of sleeve portions of the apparatus installed within the tank and surrounding the tank's electric heating elements.
FIG. 2 is an enlarged view of one of the tubular sleeve portions shown in FIG. 1.
FIG. 3 is an exploded view of FIG. 2.
FIG. 4 is a cross-sectional view taken substantially along line 4—4 of FIG. 2.
FIG. 5 is a cross-sectional view taken substantially along line 5—5 of FIG. 2 and shows the generation of an upward flow of heated water through the sleeve portion when water inside the sleeve is heated.
FIG. 6 is a cross-sectional view like FIG. 5 but is taken substantially along line 6—6 in FIG. 2.
Figure 7:
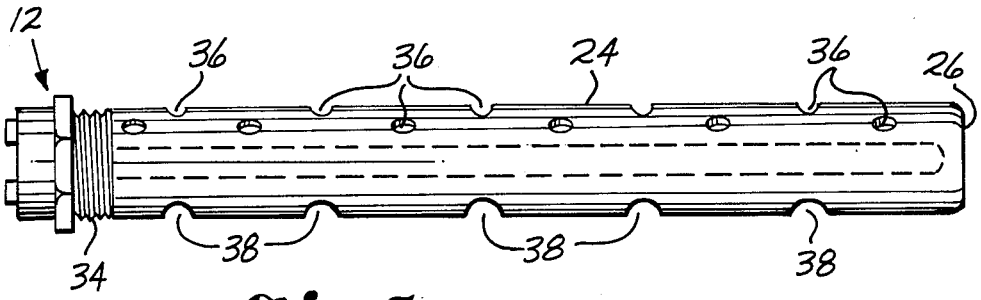
FIG. 7 is a side elevational view of the sleeve shown in FIG. 2, with the location of the heating element surrounded thereby being shown by dashed lines.

Referring now to the drawings, and first to FIG. 1, therein is shown a water heater having a reservoir tank 10 and heating elements, modified in accordance with the invention, which are indicated generally at 12. The heating elements 12 are mounted through the sidewall of the tank 10. A water supply inlet 14 delivers cold water through the tank's wall into a lower region 18 below the bottom-most heating element 12. A hot water outlet 16 allows heated water to be drawn from an upper region 20 above the upper-most heating element 12. With the exception of the modification to the heating elements 12, which will be further described below, the type of water heater construction described thus far is conventional. A person skilled in the art would be familiar with the same, including its usual mode of operation.

Referring now to FIGS. 2–6, therein is shown the above-mentioned modified heating elements 12. Each heating element 12 includes a conventional metallic sheathed electric resistance heating element 30 of the Calrod ® type which extends horizontally into the tank 10 from the tank's inner sidewall. The heating element 30 is surrounded by a cylindrical tubular sleeve which is preferably made of copper or a copper alloy, although it should be appreciated that many other suitable materials could be used. The sleeve 24 has a closed outer end 26 and an open inner end 28. The inner end 28 permits the sleeve to be placed or slid over the heating element 30 until the open end 28 abuts against a threaded plug 34 which mounts the calrod to the tank 10. One or more slotted disks 32 may be used to properly space the inner sidewall 33 of the sleeve from the heating element 30. The heating element 30 and plug 34 are of a conventional design. The doubled-back configuration of the heating element 30 is also conventional, although, preferably, each heating element segment 30*a*, 30*b* should be aligned in a substantially horizontal plane as shown in FIGS. 4–6.

Positioned in the sleeve 24, above heating element segments 30*a*, 30*b*, are a plurality of openings 36 which extend along the length of the sleeve. Positioned below the heating element 30 is a second plurality of openings 38, which also extend along the length of the sleeve. It is important that the total area of the upper openings 36 exceed the area of the lower openings 38. This configuration is important for reasons which will be further described.

By way of nonlimitative example, the upper sleeve openings 26 may include three separate rows of openings and the lower openings 38 may include a single row. It is possible, and perhaps desirable, that each individual opening 36 above the heating element 30 have an area that is less than the area of each individual opening 38 below the heating element 30. However, the total area of all openings above must exceed the total area of all openings below.

Figure 8:
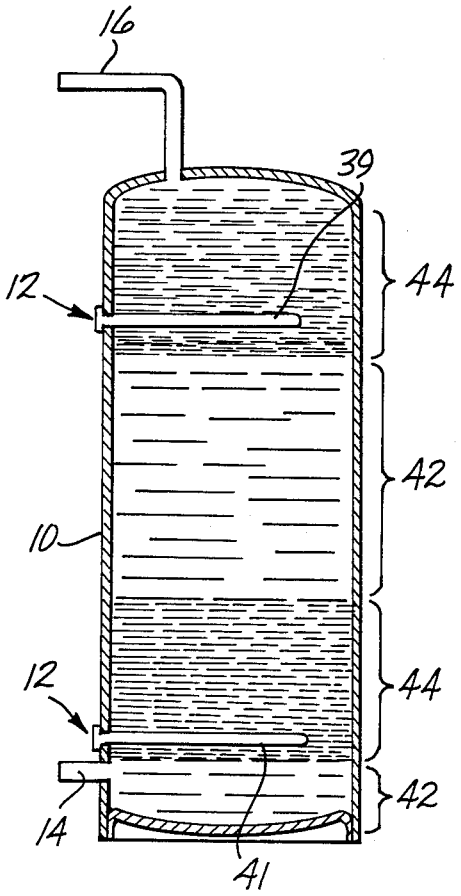
Fig. 8 PRIOR ART
FIG. 8 is a side view which schematically illustrates the basic construction of a conventional water heater that is unmodified by the present invention, and how layering of noncirculating water in the heater's tank occurs.

Referring to FIG. 8, therein is shown an unmodified water heater tank 10. This tank includes upper and lower calrods 39, 41, which are the same in form as the heating elements 30 illustrated in FIGS. 2–6, but which are unmodified. During normal operation, the upper heating element 39 is activated until a temperature sensor (not shown in the drawings) positioned immediately above this heating element 39 indicates a certain preselected temperature. Then, the lower heating element 41 is activated until a second temperature sensor (also not shown in the drawings) in the vicinity of the lower heating element 41 also indicates the preselected temperature. The resultant effect of such operation is that warmer layers of water, indicated at 44, are developed near and immediately above the heating elements 39, 41, and colder layers 42 are developed immediately below. These layers inhibit heat circulation throughout the entire tank.

Figure 9:
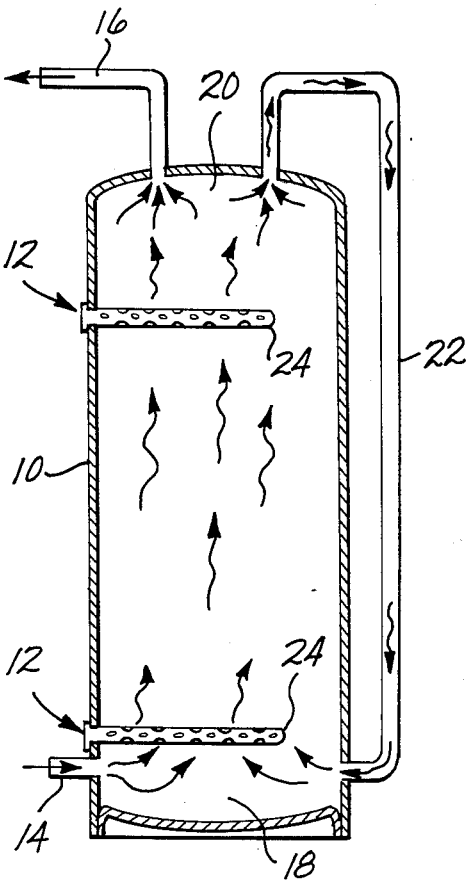
FIG. 9 is a view like FIG. 8, but shows the tank modified by the present invention, and schematically shows how the invention improves the tank's recovery rate.

When the tank is modified in accordance with the invention, as shown in FIG. 9, an external bypass conduit 22 interconnects the upper and lower tank regions 20, 18. This conduit has no valves or other flow-restricting devices. The sleeves 24 hold or "trap" water inside each sleeve near each heating element 12. Water inside the sleeve is therefore heated more quickly than it would be without the sleeve. This quicker heating action causes local temperatures of the water near the heating element 12 to be substantially higher than local temperatures of the water near an unmodified heating element. In fact, the higher temperatures may cause localized boiling, which probably never occurs with heating elements not positioned in such a sleeve.

Improved heating of water in the sleeve, in combination with the above-described holes or opening arrangement in the sleeve, generates an upwardly directed flow of heated water 40 (see FIGS. 5 and 6). This, in further combination with the external bypass 22 generates a thermosiphon effect that causes heated water in the tank's upper region 20 to be "rolled-over" to the tank's lower region 18. The thermo siphon effect therefore eliminates the previously described layering.

As would be apparent to a person skilled in the art, an advantage to the present invention is that it can be easily adapted to the modification of pre-existing electric water heaters. I have had independent tests conducted showing the difference between a conventional water heater and a water heater modified in accordance with my invention. These tests have shown that a water heater modified with the sleeves 24, and not including the bypass 22, will not have a significantly improved recovery rate. However, use of the sleeves in combination with the bypass may improve recovery rate as much as 27%.

It is to be understood the invention described above is the current best mode for carrying out the invention. It is possible, however, that the invention may be implemented in ways other than that which was described above without departing from the invention's spirit and scope. The embodiment illustrated and described above is merely an example, although it is believed to be the best example known at this time. Any patent protection due the inventor is not to be determined by the above embodiment, but is to be determined only by a proper interpretation of the following claim or claims, wherein such interpretation is to be made in accordance with the well-established doctrines of patent claim interpretation.

What is claimed is:

1. In a water heater including an elongated vertically disposed water tank adapted to be normally filled with water, a means for delivering cold water into a lower region of said tank, a means for removing heated water from an upper region of said tank, and at least one elongated heating element positioned in said tank so as to be immersed in the water between said upper and lower regions, said at least one element extending generally horizontally into said tank from an inner sidewall of said tank and being operable to heat water in said tank, the improvement comprising a thermosiphon apparatus for improving the efficiency of said water heater, said apparatus including:

an unrestricted bypass conduit positioned externally of said tank and interconnecting said upper and lower regions, said conduit permitting an unrestricted thermosiphonic flow of water between said upper and lower regions; and an elongated tubular sleeve having closed ends and surrounding each of said at least one heating element, each sleeve having a first plurality of upper openings for providing waterflow communication between said sleeve's inside and outside, said first plurality being distributed along substantially the entire length of said sleeve and being normally positioned above the heating element within said sleeve, and a second plurality of lower openings for providing waterflow communication between said sleeve's inside and outside, said second plurality being distributed along substantially the entire length of said sleeve and being normally positioned below the heating element, the total area of said upper openings being greater than the total area of said lower openings, whereby upon operation of said at least one heating element said sleeve generates along substantially the entire length thereof an upwardly directed transverse waterflow through said sleeve and in a direction from said second plurality of openings to said first plurality of openings, and acts cooperatively with said bypass conduit to cause heated water to be transferred by thermosiphonic action in said tank through said bypass conduit from said upper region to said lower region.

2. In a water heater including a water tank adapted to be normally filled with water, a means for delivering cold water into said tank, a means for removing heated water from said tank, and at least one elongated heating element positioned in said tank so as to be immersed in the water therein, said at least one element extending generally horizontally into said tank from an inner sidewall of said tank and being operable to heat said water, an improvement comprising:

an elongated tubular sleeve having closed ends and surrounding each of said at least one heating element, each sleeve having a first plurality of upper openings for providing waterflow communication between said sleeve's inside and outside, said first plurality being distributed along substantially the entire length of said sleeve and being normally positioned above the heating element within said sleeve, and a second plurality of lower openings for providing waterflow communication between said sleeve's inside and outside, said second plurality being distributed along substantially the entire length of said sleeve and being normally positioned below said heating element, the total area of said upper openings being greater than the total area of said lower openings, whereby upon operation of said at least one heating element said sleeve generates along substantially the entire length thereof an upwardly directed transverse water flow in a direction from said second plurality of openings to said first plurality of openings.

* * * * *